United States Patent [19]

Carlin

[11] 4,184,451

[45] Jan. 22, 1980

[54] RESTRAINING DEVICE FOR ANIMAL SURGERY

[76] Inventor: Milton O. Carlin, 13111 E. 11th St., Tulsa, Okla. 73117

[21] Appl. No.: 925,049

[22] Filed: Jul. 17, 1978

[51] Int. Cl.[2] ..... A61G 3/00

[52] U.S. Cl. ..... 119/103

[58] Field of Search ..... 119/103, 96; 269/328

[56] References Cited

U.S. PATENT DOCUMENTS

| | | | |
|---|---|---|---|
| 3,286,694 | 11/1966 | Landy | 119/103 |
| 3,532,336 | 10/1970 | Baker | 269/328 |

*Primary Examiner*—Jay N. Eskovitz

*Attorney, Agent, or Firm*—Head & Johnson

[57] ABSTRACT

A structure for supporting small anesthetized animals for surgical procedures in the form of an elongated rectangular base adapted for positioning on a table, the base having integral upstanding ridges on each side, each of the ridges being rounded at the top and conforming to an elongated concave surface forming the top of the base, the concave surface being dimensioned to support the supine body of a small animal, the height of each ridge being reduced at the end, and a strap adjacent each end of each ridge, each strap having one end secured to the side of the base and the other end secured to the base concave top surface, at least one end of each strap being removably secured in a manner whereby the length of each strap may be adjusted, so that the legs or feet of the animal may be retained by the straps.

10 Claims, 15 Drawing Figures

RESTRAINING DEVICE FOR ANIMAL SURGERY

BACKGROUND AND OBJECTS OF THE INVENTION

One problem which veterinarians have in performing surgical procedures on small animals, such as dogs and cats, is that of properly positioning the animals after they have been anesthetized. Since most surgical procedures are performed best when the abdominal area of the animal is upward and with the legs extended, it is most desirable that the animal be supported in such position. However, the structure of the body of small animals, particularly dogs and cats, is exactly contrary to this position, and there is no natural tendency for anesthetized animals to rest in a convenient surgical position. Therefore, it is necessary for veterinary surgeons to require the aid of one or more assistants in maintaining the animals in the preferred position for surgery.

Others have suggested devices for assisting the placement of animals in preferred surgical positions, such as V-shaped troughs and the like. However, the devices which have been suggested to the present time are not completely satisfactory. It is therefore an object of the present invention to provide an improved structure for supporting small anesthetized animals for surgical procedures.

More particularly, an object of this invention is to provide an elongated base structure having opposed paralleled ridges rounded at the top and conforming to a concave top surface of a dimension to receive and support the supine body of a small domestic animal, and including the provision of straps of adjustable length positioned on the base structure in a way so that the legs or feet of the animals may be properly secured to support the animal in the most convenient position for the specific surgery being performed.

These general objects, as well as other and more specific objects of the invention, will be fulfilled in the following description and claims, taken in conjunction with the attached drawings.

DESCRIPTION OF VIEWS

Figure 8:
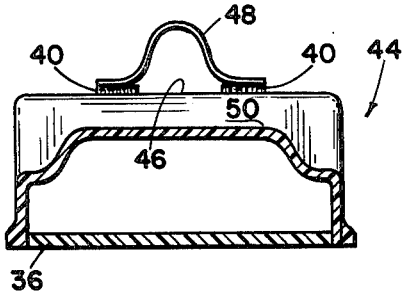
Figure 6:
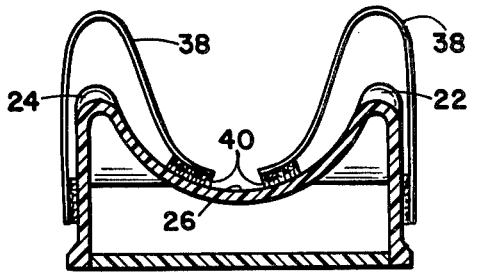
Figure 7:
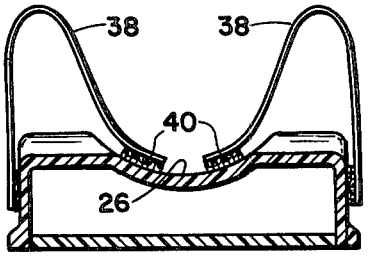
Figure 5:
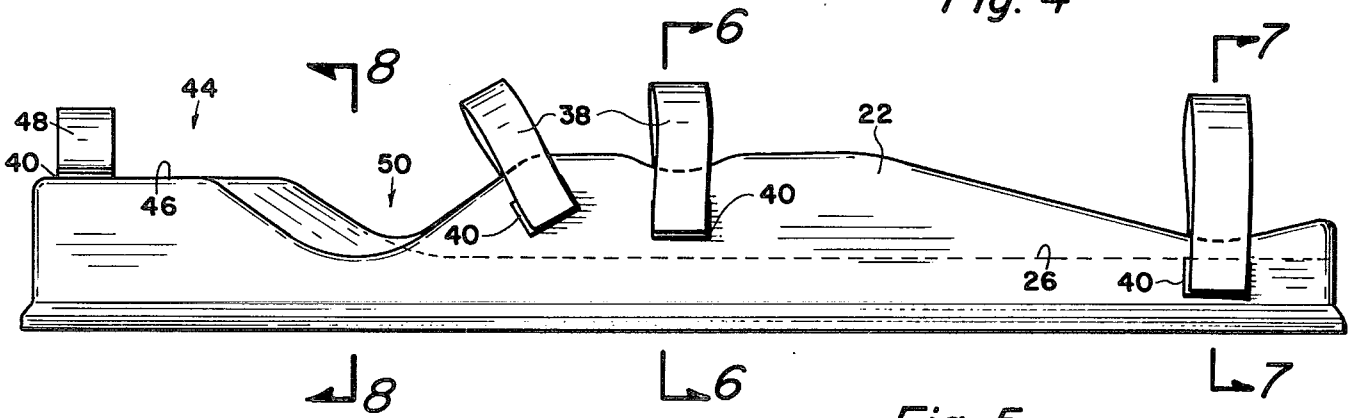
FIG. 5 is an elevational side view of the embodiment of FIG. 4.

FIGS. 6, 7, and 8 are cross-sectional views taken along the lines 6—6, 7—7 and 8—8 of FIG. 5, respectively.

Figure 1:
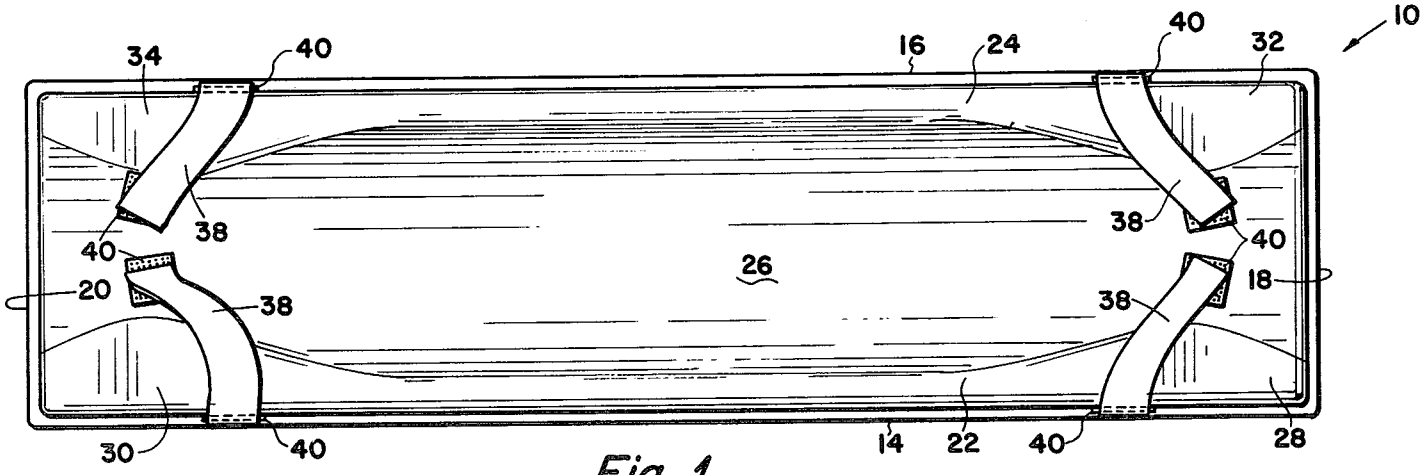
FIG. 1 is a top view of one embodiment of the structure for supporting small anesthetized animals according to this invention.
Figure 4:
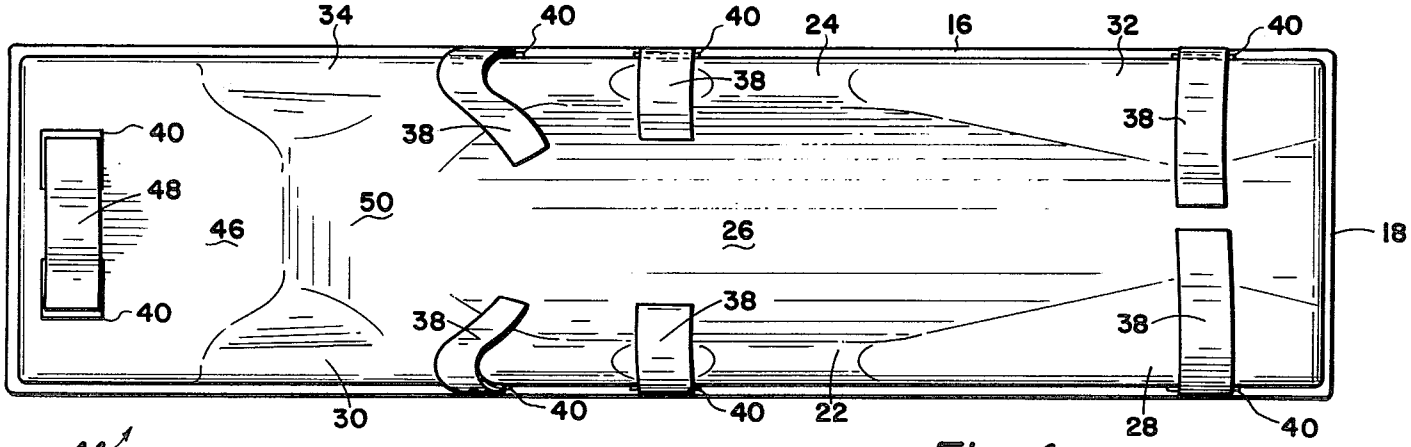
FIG. 4 is a top plan view of an alternate embodiment of the invention.
Figure 9:
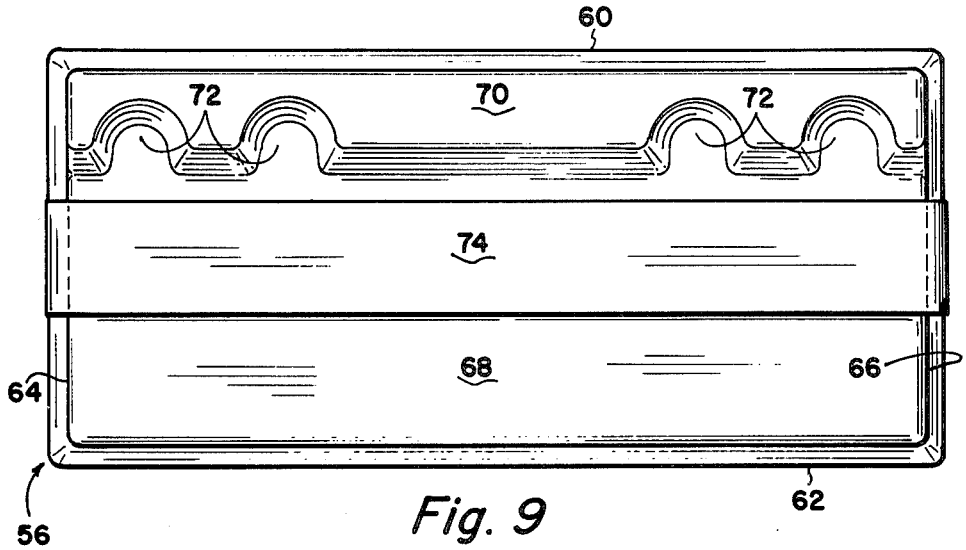

FIG. 9 is a top plan view of a second base member termed a satellite member, which may be used in conjunction with the structure f the invention as shown in either of the embodiments of FIG. 1 or FIG 4.

Figure 10:
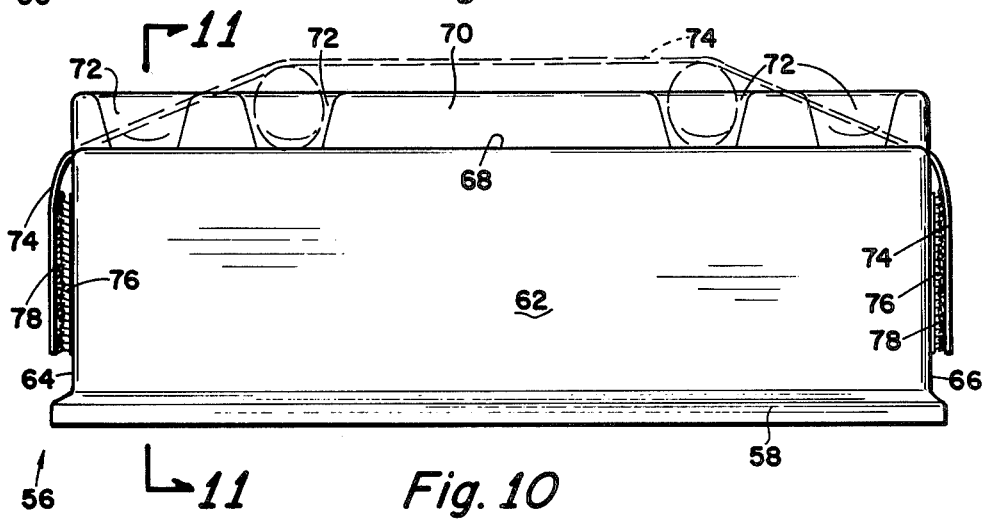

FIG. 10 is an elevational side view of the second base member of FIG. 9 and showing the strap which extends across the top of the structure utilized to attach two legs of a small animals positioned in the structure.

Figure 11:
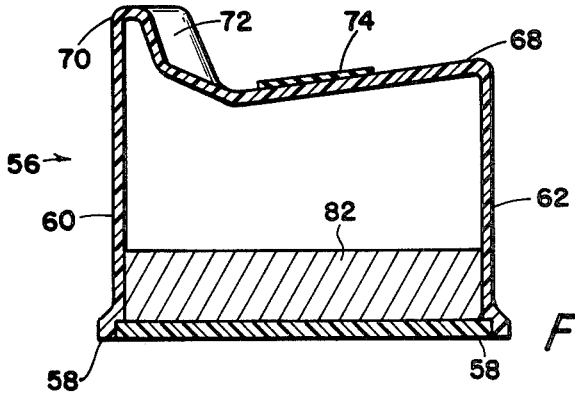

FIG. 11 is a cross-sectional view taken along the line 11—11 of FIG. 10.

Figure 12:
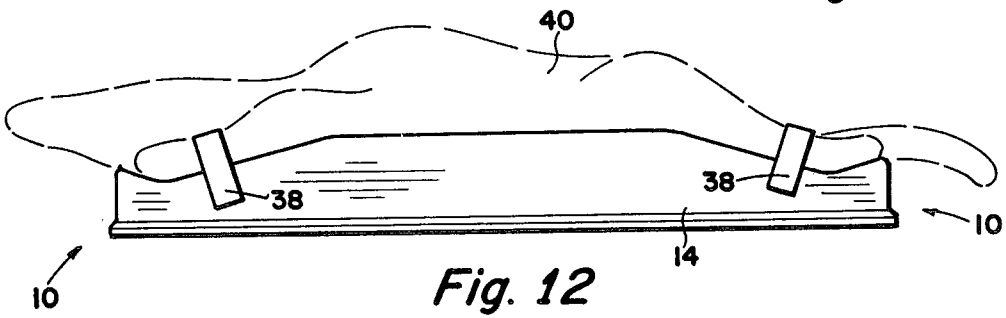

FIG. 12 shows a small animal, such as a small dog, as positioned on the embodiment of FIG. 1 of the invention, shown in elevational view.

Figure 13:
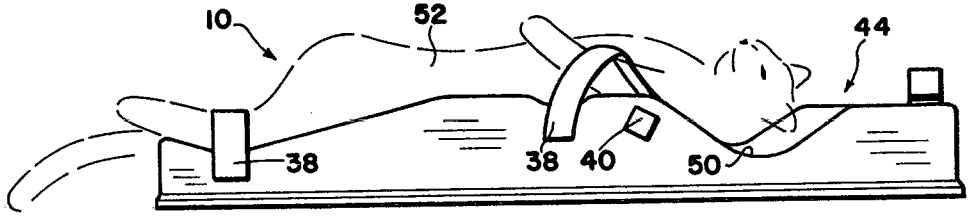

FIG. 13 is a side view of the embodiment of FIG. 4, showing this embodiment utilized to support a small animal, such as a cat, for surgical procedures.

Figure 14:
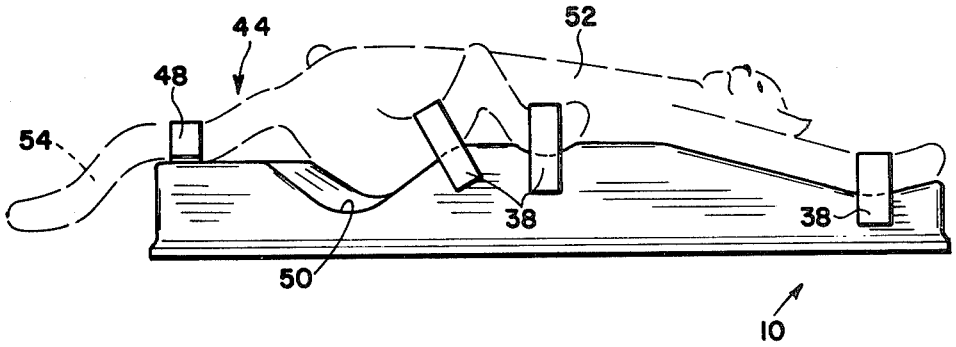

FIG. 14 is another view of the embodiment as shown in FIG. 13 but showing how the structure may be utilized to support the small animal in an alternate position.

Figure 15:
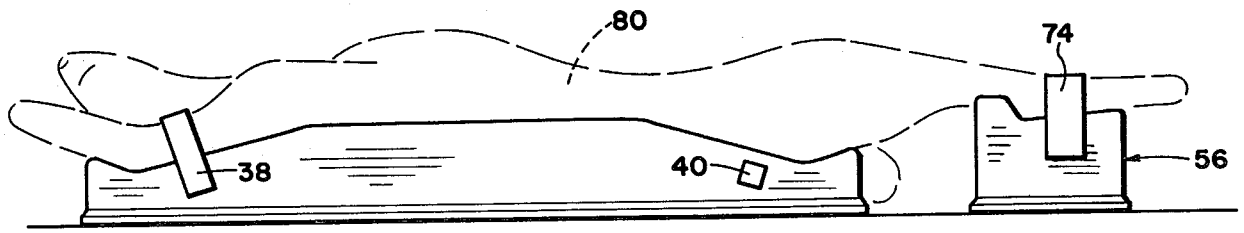

FIG. 15 illustrates the use of the embodiment of FIG. 1 in conjunction with the supplementary base of FIG. 9 for supporting an animal.

SUMMARY OF THE INVENTION

A structure is provided for supporting small anesthetized animals, such as dogs or cats, for surgical procedures, including an elongated rectangular base with a bottom adaptable for positioning on a table, the base having an integral upstanding ridge along each opposed side, each of the ridges being rounded at the top and conforming to an elongated top surface which is concave in cross-section taken perpendicular the length of the base. The top surface and ridges are dimensioned to support the supine body of a small animal. In the first embodiment the ridges are of a reduced height at each end, and in the second embodiment, an integral extended portion providing a flat top is included. In both embodiments a plurality of straps are provided for each ridge, with one end of each strap being attached to the side of the body and the other end being attached to the concave top surface. The straps are arranged to be of adjustable length. In the preferred arrangement, each strap is secured to a patch of material having a multiplicity of integral upstanding hooks while the strap itself is of a flexible material having a texture providing a multiplicity of loops, this type of material commonly referred to by the trademark "Velcro". A supplemental unit is also provided for use in conjunction with a base portion. The supplemental unit includes a top surface having a strap thereacross for receiving the legs of an animal whose body is supported on a base structure.

DETAILED DESCRIPTION

Figure 2:
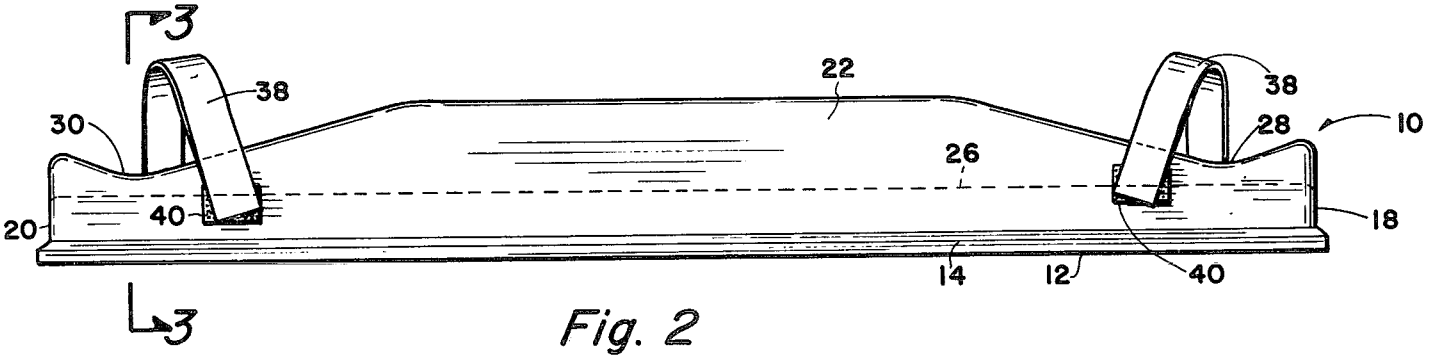
FIG. 2 is an elevational side view of the embodiment of FIG. 1.
Figure 3:
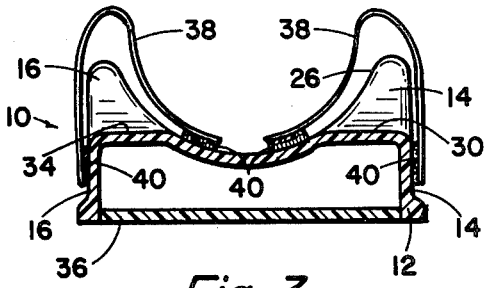
FIG. 3 is a cross-sectional view taken along the line 3—3 of FIG. 2.

Referring to the drawings and first to FIGS. 1, 2, and 3, a basic arrangement of the invention is illustrated. The structure includes an elongated rectangular base generally indicated by the numeral 10. The base 10 has a bottom 12, sides 14 and 16, and ends 18 and 20. The bottom 12 is flat or otherwise adapted so that the base 10 is positioned on a table for usage. The base includes an integral upstanding ridge 22 adjacent side 14 and a similar integral upstanding ridge 24 adjacent side 16. Ridges 22 and 24 are parallel to each other, and each is rounded at the top (see FIG. 3) to conform to top surface 26 which is an elongated surface defined in cross-section taken perpendicular the length of the body 10 by a concave configuration, also as particularly illustrated in FIG. 3.

The height of ridge 22 is reduced at each end at 28 and 30, and in like manner the height of ridge 24 is reduced at each end at 32 and 34.

The base 10 may be formed of plastic, but it preferably is of a material which is radiolucent so that an animal positioned on the base may be X-rayed without the base interfering in any way with the X-ray production or examination.

As shown in FIG. 3, the base 10 may be essentially hollow, such as when the base is formed by vacuum molding from radiolucent chemically resistant plastic. Bottom plate 36 closes the bottom surface.

Means is provided at both ridges and at the reduced height end of each, to receive a strap 38. In the embodiment of FIGS. 1, 2, and 3, four straps are employed although a greater number of straps may be utilized if desired. While the straps 38 may be attached in a variety of ways, a preferred arrangement is by the use of a commercially available product sold under the trademark "Velcro", the trademark being owned by Velcro Corp., New York. Using this fastening technique for straps 18, a patch of material 40 which has a surface providing a multiplicity of short length flexible hooks is utilized. A patch 40 is placed on side 14 adjacent the reduced height ends 28 and 30; and in like manner, patches 40 are placed on sides 16 at reduced height ends 32 and 34. In addition, as shown in FIGS. 1 and 3, patches 40 of the Velcro hook material are positioned on the concave top surface 26. Straps 38 each have an inner surface which is of a material providing a multiplicity of small loops which, when pressed against the resilient hooks of a patch 40, are received by the hooks and thereby the straps are held in position. With sufficient pressure, the flexible hooks are disengaged from the loops, and the straps are thereby removably attached to patches 40. This arrangement has the advantage that the length of the straps may be easily adjusted. Further, the straps may be easily removed completely for washing if they become soiled with blood as a result of operating procedures.

Normally the material of which patches 40 consist includes an adhesive backing so that it is easily attached to the side surfaces 14 and 16 and the concave top surface 26.

The use of the device depicted in FIGS. 1, 2, and 3, is illustrated in FIG. 12. Here an anesthetized small dog is in a supine position with his back resting on the concave top surface 26 of the base, each front leg and each rear leg is retained by straps 38. As so positioned, the dog is held with the stomach and chest portions of the body upwardly exposed where mot surgical operations are performed. However, it can be seen that if the surgical procedure required the exposure of the animal's anterior portion, the animal could equally as well be held in position supported with his stomach in contact with the concave top surface 26.

An alternate embodiment of the invention is illustrated in FIGS. 4, 5, 6, 7, and 8. This embodiment is essentially the same as that illustrated and described with reference to FIGS, 1, 2, and 3 except that it is longer and includes an integral extension portion generally indicated by the numeral 44. The extension portion is contiguous with the base 10 and with the reduced height portions 30 and 34 of ridges 22 and 24. The extension portion 44 has a flat upper surface 46. The concave upper surface 26 tapers upwardly to merge with the extension flat surface 46. A deep notch section 50 connects the extension portion 44 with the main part of the structure. The height of the flat surface 46 is equal to or preferably, as illustrated, slightly less than the height of ridges 22 and 24.

A strap 48 is placed on the top surface 46 such as by use of two Velcro patches 40 secured to the top surface 46. The cross-sectional views of FIGS. 6, 7, and 8 show the shape of the member 10, including the extension portion 44.

FIGS. 13 and 14 illustrate two ways in which the embodiment of FIGS. 4 and 5 may be employed. FIG. 13 shows a cat 52 positioned wherein the head of the cat is supported in the deep notch 50. FIG. 14 shows an arrangement wherein the hip portion of the cat is placed in notch 50.

The strap 48 on the top surface of the extension portion 44 is used to hold the tail 54 of the animal. FIGS. 13 and 14 are merely illustrative of two arrangements for utilizing the structure for supporting small animals in various portions for surgical or X-ray procedures. It can be seen that with the animals as positioned, surgery or X-rays may be completed by the veterinary surgeon without the help of an assistant.

Another embodiment of the invention includes the provision of a second base member or satellite unit, as illustrated in FIGS. 9, 10, and 11, the second base member being generally indicated by the numeral 56. This second base member is preferably formed of molded or vacuum formed plastic or radiolucent material. The second base 56 includes a bottom 58 for resting on a table adjacent to the first base member 10. Second base 56 further includes sides 60 and 62 and ends 64 and 66. The top surface 68 is of height substantially equal to the height of the first base member 10 and includes an integral upstanding portion 70 having a plurality of notches therein (four notches being illustrated). Notches 72 are configured to receive the feet or portions of the legs of an animal during surgical procedures and particularly and hock joint of the animal as illustrated in FIG. 15.

Extending across the top surface 68 is a strap 74 which may be in the form of a radiopaque elastomeric member. Patches of Velcro hook material 76 are positioned on ends 64 and 66, and patches of Velcro loop material are secured to the ends of strap 74. By use of an elastomeric strap 74, the legs of an animal are more readily restrained while the use of the Velcro patches 76 and 78 provide an easy means for disconnecting the strap of one side for positioning over the extended legs of the animal.

The second base unit 56, which may be considered a satellite surgical supporting form, is used in conjunction with first base 10 as illustrated in FIG. 15. An animal 80 of a larger size, such as a large dog, is positioned on the first base 10 but with legs extending out and restrained by strap 74 extending across the top of the satellite base unit 56. In order to make sure that the animal does not move the satellite base 56 about, it is preferably made heavy by means of a weight 82 positioned in the interior of the structure adjacent the bottom 58.

It can be seen that the invention may be very effectively utilized to restrain small domestic animals, both feline and canine, in many postural attitudes, both dorsoventral and ventrodorsal. The forms described herein are particularly useful for feline castration, urethrostomy, onychectomy, canine ear trimming, and so forth. The structures permit assistant-free restraint for radiography and surgical procedures.

While the invention has been described with a certain degree of particularity, it is manifest that many changes may be made in the details of construction of the invention without departing from the spirit and scope hereof. It is understood that the invention is not limited to the embodiments set forth herein for purposes of exemplification, but is to be limited only by the scope of the attached claim or claims, including the full range of equivalency to which each element thereof is entitled.

What is claimed is:

1. A structure for supporting small anesthetized animals for surgical and X-ray procedures, comprising:

an elongated rectangular base having sides and ends and with a bottom for positioning on a table, and having an integral upstanding ridge along each side, each side ridge being rounded at the top and conforming to an elongated top surface which is concave in cross-section taken perpendicular the length of the base, the top surface and ridges being dimensioned to support the supine body of a small animal, the height of each ridge being reduced at each end; and a strap adjacent each end of each ridge, each strap having one end secured to the side of the base side and the other end secured to the base concave top surface, at least one end of each strap being removably secured and in a manner whereby the length of each strap is adjustable.

2. A structure for supporting small anesthetized animals for surgical and X-ray procedures according to claim 1, wherein each strap has one surface formed of a fabric providing a plurality of loops of filaments and wherein the strap is removably secured to the base concave top surface by means of a patch of material having an upper surface formed of upstanding filaments, each configured in a hook at the upper end.

3. A structure for supporting small anesthetized animals according to claim 2 wherein each said strap is removably secured to the side of the base by a patch of material having an upper surface formed of upstanding filaments, each configured as a hook at the upper end.

4. A structure for supporting small anesthetized animals for surgical and X-ray procedures according to claim 1 including at least one strap positioned intermediate said straps adjacent each end of each said integral ridge, each intermediate strap having one end secured to a base side and the other end secured to the base concave top, at least one end of each intermediate strap being removably secured and in a manner whereby the length of each strap is adjustable.

5. A structure for supporting small anesthetized animals for surgical and X-ray procedures according to claim 1 wherein said base includes an integral extension portion at one end contiguous with said ridge reduced height ends, the extension portion having a flat upper surface, said concave upper surface of the base tapering upwardly to merge with the extension flat surface, the height of the flat surface being equal to or less than the height of said ridges; and including a strap affixed to the extension top surface, the strap extending perpendicular the length of the base, the strap having means of attachment providing variable length.

6. A structure for supporting small anesthetized animals for surgical and X-ray purposes according to claim 1 including:

a second base member of rectangular configuration having a bottom for resting on a table adjacent said first base, the second base being of height substantially equal said first base and having a horizontal upper surface; and including a strap extending from one side to the other of the second base member across the top surface thereof, at least one end of the strap being detachably secured, the second base being adaptable to receive the legs or feet of an animal supported on the first base.

7. A structure according to claim 6 wherein said strap affixed to said second base is elastomeric.

8. A structure according to claim 1 wherein said base is radiolucent.

9. A structure according to claim 6 wherein said first base and second base are radiolucent.

10. A structure according to claim 6 wherein said second base is weighted.

* * * * *